US007024905B1

(12) United States Patent
Carlson et al.

(10) Patent No.: US 7,024,905 B1
(45) Date of Patent: Apr. 11, 2006

(54) PORTABLE ELECTRICAL CONDUIT PIPE BENDING SYSTEM

(76) Inventors: Aaron Carlson, P.O. Box 591, Manteno, IL (US) 60950; Roy Imwie, III, P.O. Box 591, Manteno, IL (US) 60950

( * ) Notice: Subject to any disclaimer, the term of this patent is extended or adjusted under 35 U.S.C. 154(b) by 339 days.

(21) Appl. No.: 10/425,456

(22) Filed: Apr. 28, 2003

(51) Int. Cl.
*B21B 7/02* (2006.01)
*B21D 9/05* (2006.01)

(52) U.S. Cl. ..... 72/217; 72/388

(58) Field of Classification Search ..... 72/214, 72/215, 216, 217, 218, 219, 293, 306, 380, 72/387, 388, 389.1, 449
See application file for complete search history.

(56) References Cited

U.S. PATENT DOCUMENTS 1,462,315 A * 7/1923 Akey et al. ..... 72/212
1,546,147 A * 7/1925 Skinner ..... 72/217
1,769,570 A * 7/1930 Groehn et al. ..... 72/217
1,816,218 A * 7/1931 Henry et al. ..... 72/31.04
4,052,875 A * 10/1977 Sakamoto ..... 72/217
4,249,407 A * 2/1981 Fogleman ..... 72/217
4,355,528 A * 10/1982 Rothenberger ..... 72/388
5,203,192 A * 4/1993 Kimura ..... 72/217
5,588,322 A * 12/1996 Passone ..... 72/383

* cited by examiner

*Primary Examiner*—Dmitry Suhol
(74) *Attorney, Agent, or Firm*—Goldstein Law Offices, P.C.

(57) ABSTRACT

A pipe bending system for bending a length of pipe, using a pair of bending assemblies, each bending assembly having a hub having a central shaft having an outer circumference and a central shaft, and a roller assembly mounted for orbital movement around the outer circumference under the power of a motor. The roller assembly has a roller whereby the length of pipe is placed between the roller and outer circumference. When the roller assembly is moved around the hub, the pipe is bent to follow the outer circumference. The bending assemblies are mounted in proximity to each other to create complex bends in the pipe.

6 Claims, 8 Drawing Sheets

PORTABLE ELECTRICAL CONDUIT PIPE BENDING SYSTEM

BACKGROUND OF THE INVENTION

The invention relates to a portable pipe bending system. More particularly, the invention relates to a system which allows a variety of different conduit pipe bending operations to be carried out, including the creation of pairs of complementary and parallel bends in a single length of pipe.

Although metal pipe is generally used for carrying liquids, including fresh water and waste products, it is also widely used for containing electrical wires in electrical power distribution systems. In most locales, electrical codes dictate that any electrical supply wires traveling installed within a building structure which is outside of a wall must be contained within a metal pipe. In addition, electrical codes often even require that certain in-wall wiring be contained within pipe.

The reasons for such requirements is of course safety. The pipe can prevent accidents where electrical wires are inadvertently severed and cause fires and electrocution. Unfortunately, the use of pipe removes the ease of installing otherwise flexible electrical conduits. Accordingly, when pipe is required, an electrician must use a variety of couplers to maintain the integrity of a pipe system. In addition, pipe is generally supplied in straight lengths. These straight lengths are suitable for long straight runs, such straight runs are more the exception than the rule. In reality, a typically dwelling requires that the conduit take numerous bends and curves to fulfill the purposes of the installation. In addition, since electrical installation is generally carried out after plumbing and HVAC installation, often few alternatives are left for the subsequent installation of electrical pipe. Often, for instance, it is might not otherwise be necessary for the pipe to be bent to reach its destination. Obstacles, however, require that the pipe have a pair of complementary curves to 'zigzag' or otherwise travel around the obstacles.

Since metal pipe is rigid by nature, various devices are used to facilitate their bending. The most common type includes a semicircular track and an elongated handle. The user employs manual leverage to effect a bend in the pipe. Unfortunately, the use of such devices is a relatively imprecise operation, resulting in much wasted pipe. Further, the creation of complex bends or pairs of complementary or parallel bends requires considerable skill, is time consuming, and often results in even more wasted pipe.

While these units may be suitable for the particular purpose employed, or for general use, they would not be as suitable for the purposes of the present invention as disclosed hereafter.

SUMMARY OF THE INVENTION

It is an object of the invention to produce a pipe bending system which is capable of automatically bending metal pipe, without requiring significant mechanical effort. Accordingly, the pipe bending system is motorized, such that once set by the user, the bending operation is carried out precisely and without manual effort.

It is another object of the invention to provide a pipe bending system which is capable of creating complex, complementary, and parallel bends. Accordingly, two bending assemblies are provided in a common plane. They are mounted upon tracks adjust the distance between them and thereby adjust the distance between bends. Placement of the pipe by the user with respect to the bending assemblies allows for both numerous variations in the types of bends, and ensures precision in the bends thus created.

It is yet another object of the invention to provide a pipe bending system which is safe to operate. Accordingly, a shoe assembly is associated with each bending assembly, and is adjustable positionable by the user, according to the prospective bending operative. Each shoe assembly engage the pipe in a locked position with respect to the bending assembly, to thereby firmly hold the pipe while the pipe bending operation is carried out.

It is a further object of the invention to provide a pipe bending system which is portable so that it may be easily carried between job sites. Accordingly, the bending system is preferably provided as two table top units, which may be secured together for use, and may be easily detached for easy transport.

The invention is a pipe bending system for bending a length of pipe, using a pair of bending assemblies, each bending assembly having a hub having a central shaft having an outer circumference and a central shaft, and a roller assembly mounted for orbital movement around the outer circumference under the power of a motor. The roller assembly has a roller whereby the length of pipe is placed between the roller and outer circumference. When the roller assembly is moved around the hub, the pipe is bent to follow the outer circumference. The bending assemblies are mounted in proximity to each other to create complex bends in the pipe.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
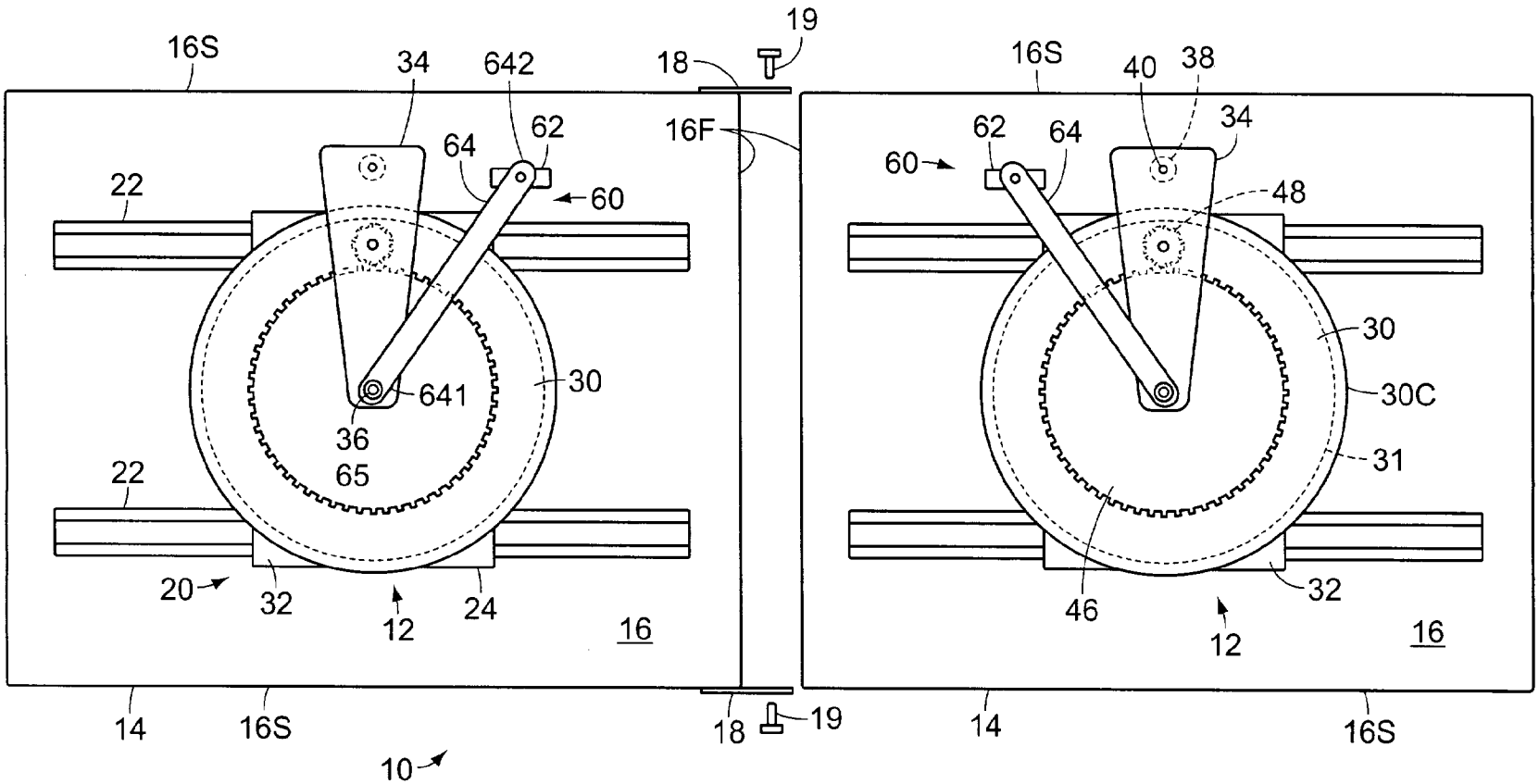
FIG. 1 is a top plan view of the pipe bending system, per se, wherein the tables are being secured together prior to use.

FIG. 1 illustrates a pipe bending system 10, having a pair of bending assemblies 12. The bending assemblies 12 are each mounted upon a table portion 14, each having a tabletop 16 having a pair of side surfaces 16S and a facing surface 16F which adjoins the facing surface 16F of the other table portion 14 during use. The table portions 14 are preferably secured to each other prior to use—to prevent lateral movement therebetween during use. In this regard, tabs 18 may be employed to each extend laterally from one the side surfaces 16S of one of the table portions 14, beyond the facing surface 16F, so that it can be mated with the side surface of the other table portion 14 with a pin 19, bolt, or the like.

Figure 4:
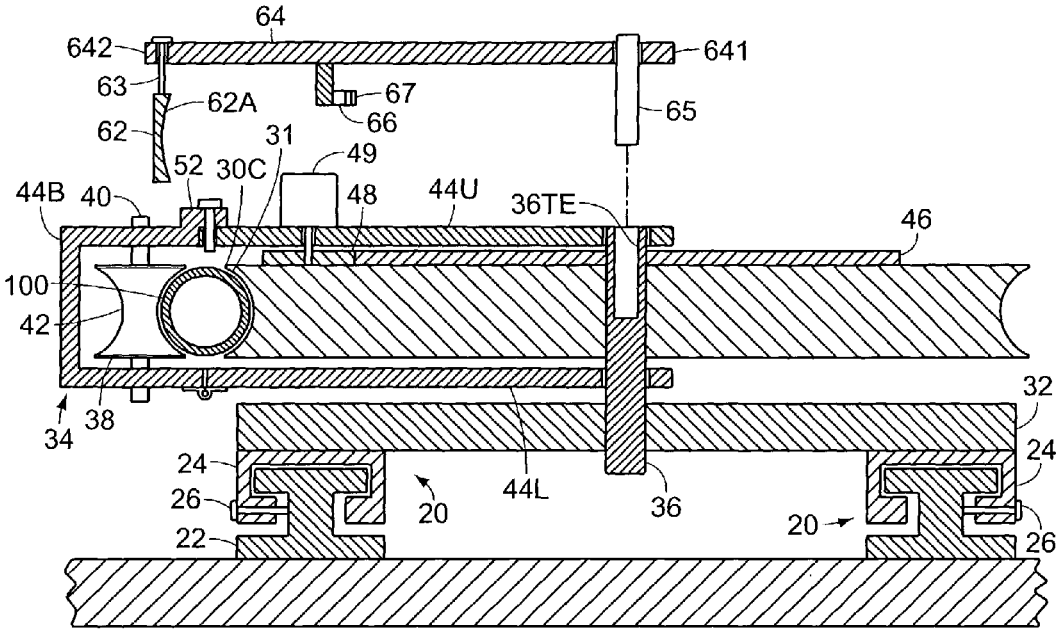
FIG. 4 is a cross sectional view, taken generally in the direction of line 4—4 in FIG. 2, illustrating details of one of the bending assemblies, except wherein the shoe assembly associated with the bending assembly has been removed therefrom, is being positioned, and is about to be lockably engaged with the bending assembly.

Each bending assembly 12 are preferably mounted upon the tabletop 15 to allow adjustment of their position with respect to the facing surface 16F of its associated table portion 14. In this respect, the distance between the pipe bending assemblies 12 may be adjusted. To facilitate such adjustment, Each bending assembly 12 is preferably mounted to its table portion 14 with a track assembly 20. As illustrated in FIGS. 1 and 4, the track assembly 20 can include a pair of parallel rails 22, fixed to the tabletop 16, and a pair of tracks 24 located at a bottom portion of the bending assembly, such that the tracks 24 allow slidable yet secure movement of the bending assembly upon the rails 22. A fixing device 26 on at least one of the tracks 24 allows the tracks 24 to be selectively positionally fixed with respect to the rails 22. Accordingly, the fixing device 26 may be in the form of a set-screw which may be loosened to allow the distance between bending assemblies 12 to be adjusted, and then tightened to lock the bending assemblies 12 in position prior to performing a bending operation.

Referring to FIG. 1 and FIG. 4, each bending assembly 12 has a hub 30, a base 32, and a roller assembly 34, and a vertically extending central shaft 36. The base is fixedly mounted atop the tracks 24. The central shaft 36 is fixed to the base 32 and extends upwardly therefrom. The roller assembly 34 is also mounted to the shaft, but is mounted for rotation thereon.

The hub 30 is substantially circular, having an outer cicumference 30C, a top 30T, a bottom 30B, and a hub flange 31 which extends inwardly from the circumference for accommodating a pipe 100. In particular, the pipe 100 has a consistent pipe circumference 100C and a pair of pipe ends 100E, best seen with momentary reference to FIG. 9. The pipe circumference 100C extends within the hub flange 31, such that the pipe circumference 100C is tangential with the hub outer circumference 30C when the pipe is straight, and generally follows the hub outer circumference 30C once the pipe is bent.

The roller assembly 34 includes a roller 38 which has a vertical roller axial shaft 40 and a roller flange 42 for also accommodating the pipe 100, such that the pipe extends horizontally through the roller flange 42. In particular, the pipe is held closely between the roller flange 42 and the hub flange 31 prior to, during, and just after the pipe bending operation. It is therefore the movement of the roller with respect to the outer circumference 30C of the hub 30 which effects the bending of the pipe. In particular, the roller assembly 34 includes upper and lower roller assembly arms 44U and 44L which extend radially outward from the central shaft 36 such that they maintain the roller at a fixed radial distance from the central shaft 36, maintain the roller at a fixed distance from the hub outer circumference 30C. Accordingly the angular movement of the roller assembly arms 44U, 44L around the central shaft 36 urges the otherwise straight pipe inward toward the outer circumference 30C of the hub 30 such that the pipe 100 will then bend to take on the shape provided by the outer circumference 30C of the hub 30. The roller 38 is mounted between the upper and lower roller assembly arms 44U and 44L with the vertical roller axial shaft 40 which allows free rotation of the roller 38 thereon as it moves along the pipe.

Figure 6:
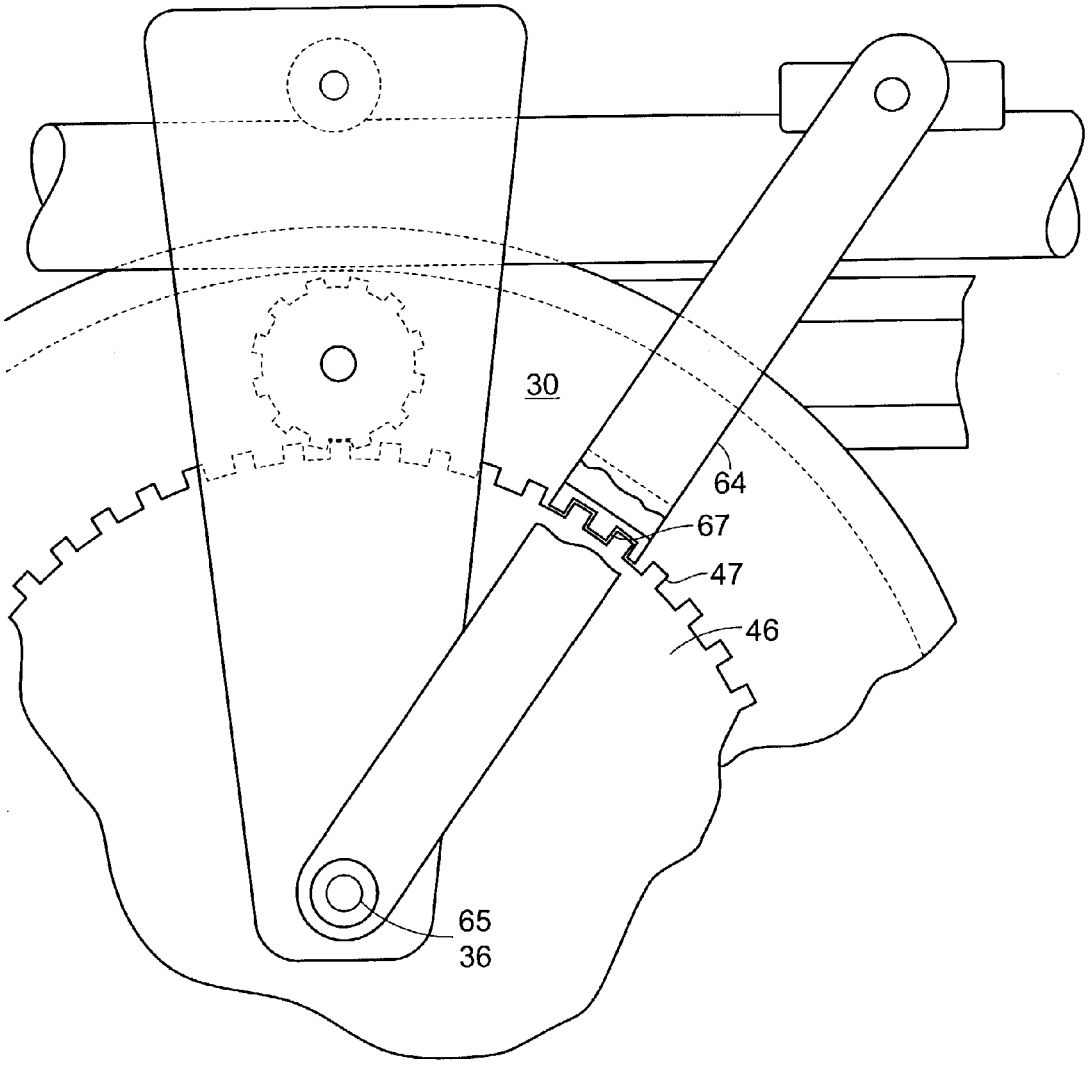
FIG. 6 is a top plan view, detailing a portion of the bending assembly, and a portion of the shoe assembly arm broken away to show the lower pawl mounted beneath the shoe assembly arm and its engagement with the fixed gear of the bending assembly to lock the position of the shoe with respect to the pipe.

To facilitate this movement, the hub 30 has a fixed gear 46 mounted to the hub top 30T, which may also be fixed to the central shaft 36. The fixed gear 46 has a circumference 36C having a plurality of teeth 48 extending radially thereat. A pinion gear 48 is mounted to the roller assembly 34, beneath the upper arm 44U thereof. Referring to FIG. 6, the pinion gear 48 has teeth 49 which engage the fixed gear 46. Accordingly, movement of the pinion gear 48 around the fixed gear 46 effects movement of the roller assembly 34 around the hub circumference 30C and thereby effects bending of the pipe. To power such movement of the pinion gear 48, a motor 49 is mounted to the upper arm 44U to drive the pinion gear 48 and is selected and/or geared so as to provide sufficient power to bend the pipe.

To ensure strength of the roller assembly 34 under the significant stresses is encounters while bending the pipe, the upper and lower arms 44U, 44L thereof are preferably bridged fully opposite from the central shaft 36 with a vertical brace 44B. In addition, to facilitate removal of the pipe once bent—and even make insertion of a straight pipe easier, the roller assembly 34 preferably includes an inner portion 34A and an outer portion 34B. The outer portion 34A is hingeably attached to the inner portion 34A at the lower plate 44L, and is selectively rigidly attached at the upper plate 44U with latch 52. For structural strength, the latch 52 includes an overlap 54 of the outer portion 34B of the upper arm 44U partially over the inner portion 34A of the upper arm 44U. In addition, the latch 52 includes a vertical outer portion hole 56A and a vertical inner portion hole 56B, which are concentric when the overlap 54 extends over the inner portion 34A, and allow a connecting pin 58 to be inserted therein to provide the requisite rigidity for the roller assembly 34 during pipe bending. Of course, numerous variations in the latch assembly can be made with these same functional constraints. For simplicity, the latch 52 and connecting pin 58 have been omitted from FIGS. 1–3 and 6–8.

The pipe 100 is generally held securely between the hub flange and the roller flange. However, as the pipe 100 is bent, torquing thereof might cause the free ends thereof to move outwardly of the table portion 14 and cause injury. Further, due to the forces exerted upon the pipe during bending, the pipe may slip longitudinally, and provide an undesirable result. To prevent such problems, a shoe assembly 60 is preferably provided in conjunction with each bending assembly 12, to hold the pipe at an additional point to ensure a precise bend, and maintain the pipe in position during the bend to prevent injury to others. The shoe assembly 60 may be configured in numerous ways. A preferred arrangement, however, is illustrated in the drawing figures, and described in detail herein.

Figure 5:
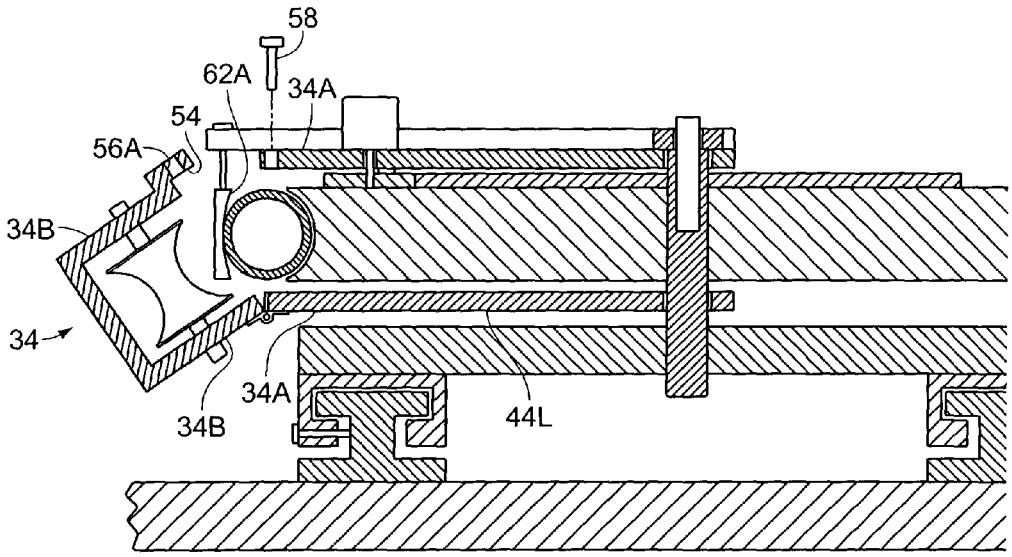
FIG. 5 is a cross sectional view, similar to FIG. 4, except wherein the outer portion of the roller assembly has been detached at its upper arm, to allow the downward pivot thereof for allowing the pipe to be inserted or removed between the roller and hub flange.

In particular, the shoe assembly 60 includes a shoe 62, and a shoe arm 64 which mates the shoe 62 with a fixed portion of the pipe bending system 10, and preferably with the hub 30. By the preferred embodiment, the shoe arm 64 has a first end 641 which has a shoe arm pin 65 that selectively attaches to the central shaft 36, and a second end 642 where to the shoe 62 is mounted. As seen in FIG. 4 and FIG. 5, the central shaft 36 has a top end bore 36TE which is sized to accommodate the shoe arm pin 65 therein, yet easily allow removal of said pin when desired. The shoe 62 has having a shoe inner surface 62A that is curved about a horizontal centerline to engage the pipe, and a shoe pin 63 which attaches the shoe 62 to the shoe arm 64. The shoe inner surface 62A may include rubber, or another suitable coating, covering, or finish which helps prevent longitudinal movement of the pipe. The shoe also has a shoe pawl 66, having several shoe pawl teeth 67. The shoe pawl 66 is mounted to the shoe arm 64 to extend immediately therebelow, and is positioned such that (referring to FIG. 6) when the shoe arm pin 65 is engaged with the central shaft 36, the pawl 66 is engaged with the fixed gear 46, such that the pawl teeth 67 are engaged with the fixed gear teeth 47 to lock the shoe arm 64 in a fixed angular position with respect to the hub 30.

Figure 2:
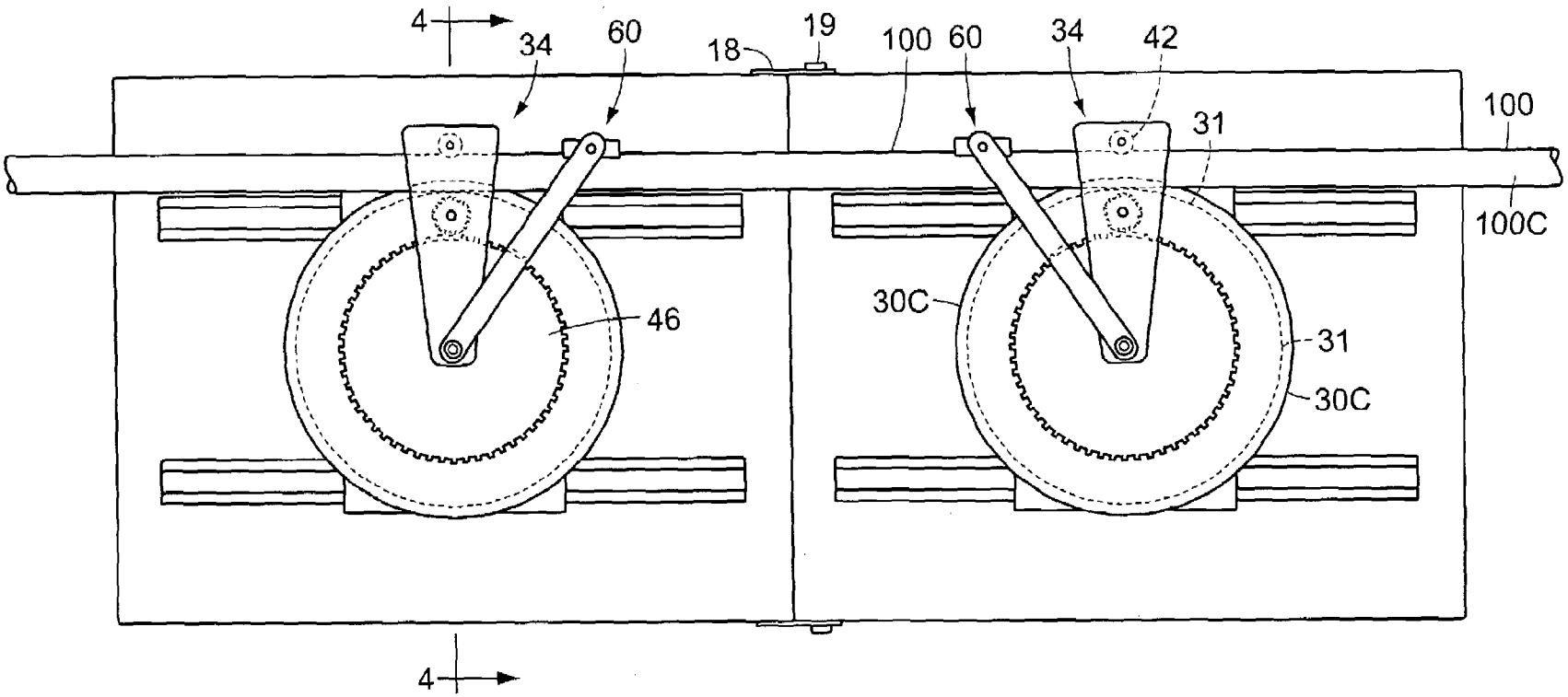
FIG. 2 is a top plan view of the pipe bending system, wherein a pipe is positioned therein prior to bending, the pipe extending between the roller and hub flange of each of the bending assemblies, and held in place by the shoe assemblies associated therewith.

Accordingly, to initiate a pipe bending operation, the pipe 100 is inserted longitudinally between the hub flange 31 and roller flange 42 of each of the bending assemblies 12 as illustrated in FIG. 2. Prior to insertion of the pipe, however, relative positioning of the bending assemblies 12 as well as the angular positioning of the roller assemblies on their respective hubs 30 may be set in accordance with the particular bending operation to be performed. In FIG. 2, where it is desirable to perform a pair of opposed right angle bends so that the pipe ends 100E extend parallel and in the same direction, the roller assemblies 34 are initially positioned in parallel, "12 O'clock" positions.

The shoe assemblies 60 are then positioned so as to engage the pipe 100 with the shoe at points on the pipe 100 in between the roller assemblies 34. The shoe arms 60 are locked into position by engaging their lower pawl assembly 66 with the fixed gear 46 as previously described and as illustrated in FIG. 6. Once the pipe is secured and suitably positioned, pipe bending can commence. The actual bending of the pipe, as previously discussed, involves operating the motors 50 so that the roller assemblies 34 are moved around the fixed gear, so that the rollers thereof bend the pipe to follow the outer circumference 30C of the hub to trace the movement of the roller assemblies 34 therearound.

Figure 3:
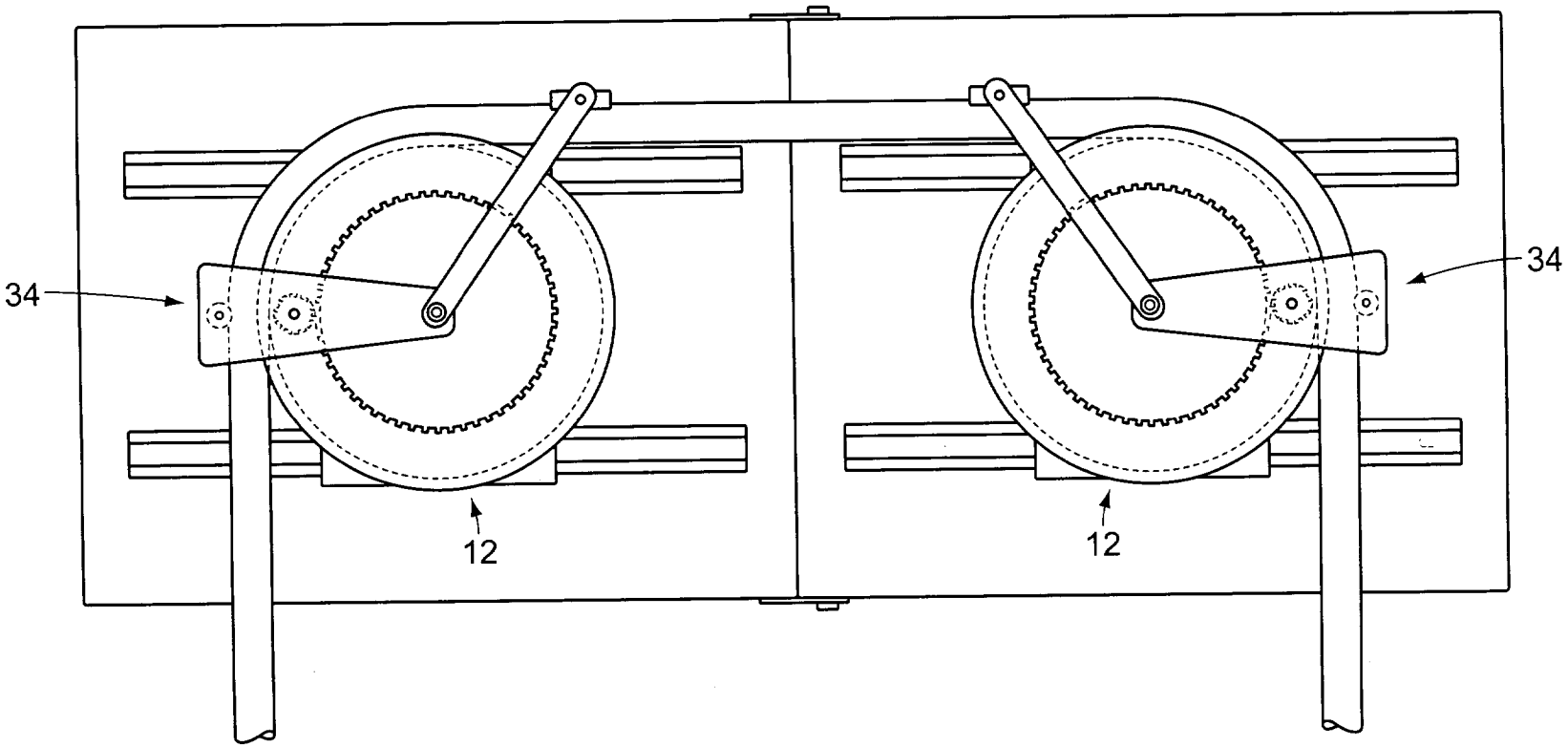
FIG. 3 is a top plan view thereof, wherein the pipe bending system has been operated, and has created a return pipe having a U-shaped bend, wherein a pair of right angle bends are created such that the free ends of the pipe extend parallel and in the same direction.

Accordingly, precisely controlling the range of angular movement of the roller assemblies is essential to creating the bend desired. With particular reference to FIG. 3, in order to create the curved right angle bends illustrated, the roller assemblies 34 each moved ninety degrees with respect to the central shaft, or each followed a ninety degree arc of the hub circumference 30C. In addition, to create the parallel bends illustrated, the roller assemblies 34 of the respective bending assemblies 12 were moved in opposite directions. In particular, one roller assembly 34 has moved ninety degrees clockwise, while the other roller assembly 34 was moved ninety degrees counter-clockwise.

Figure 7:
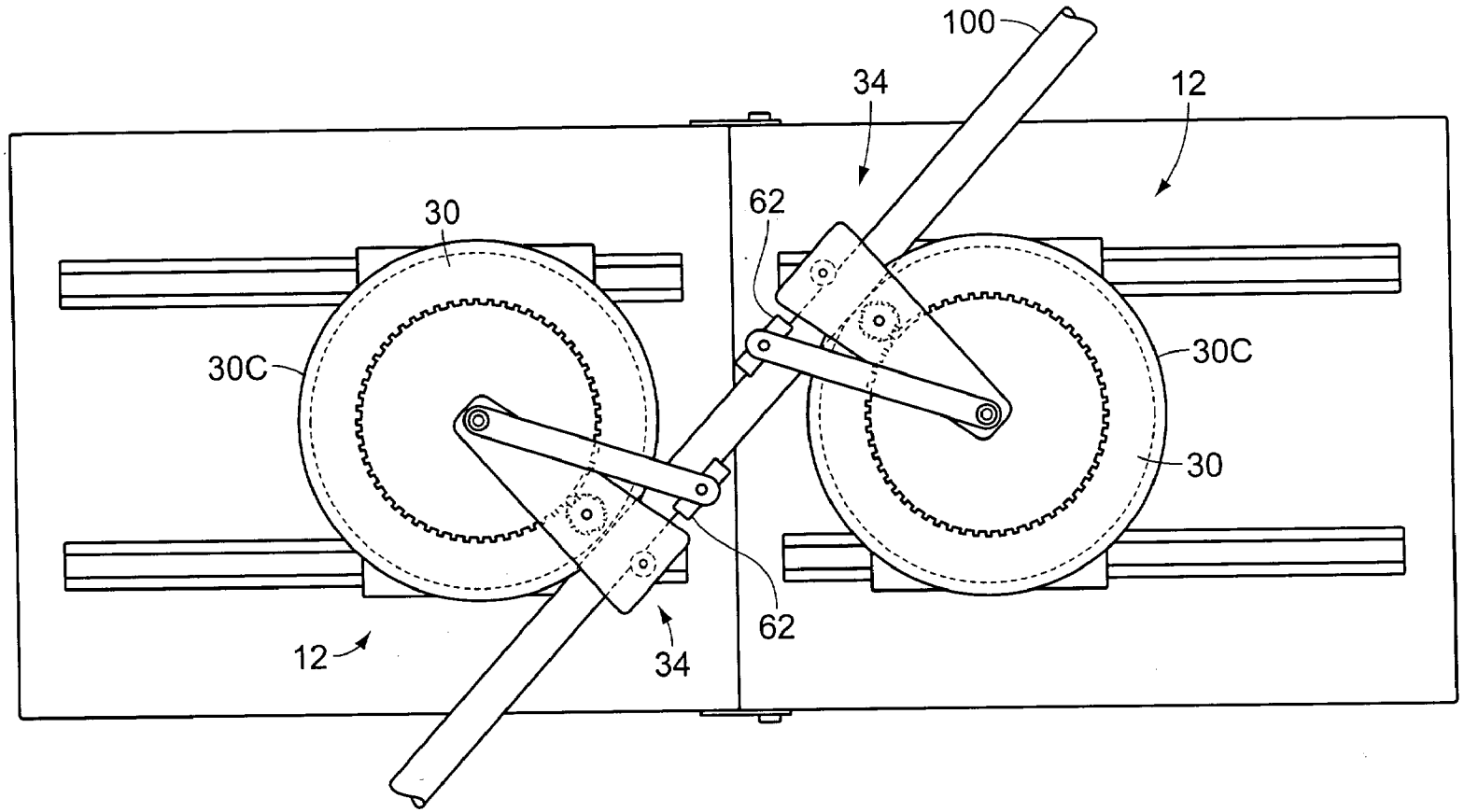
FIG. 7 is a top plan view, similar to FIG. 2, except wherein the pipe has been positioned between the bending assemblies, to facilitate the creation of complementary bends.
Figure 8:
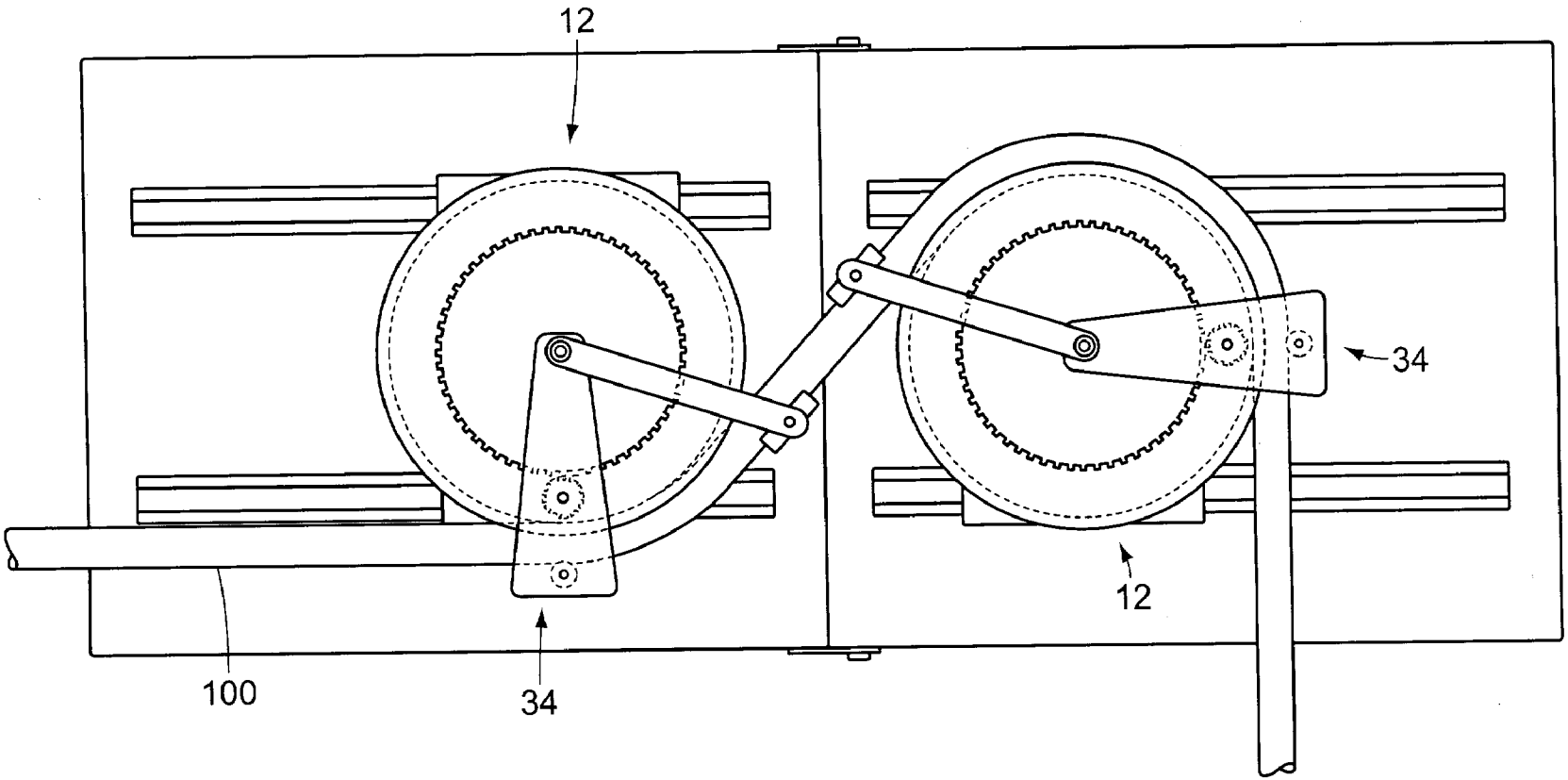
FIG. 8 is a top plan view, similar to FIG. 7, wherein the bending system has been operated upon the set-up shown in FIG. 7 to create a complex bend by selective and independent control of the two bending assemblies.

Reference to FIGS. 7 and 8, however, reveals a very different bending set-up, and a very different bending result. In particular, the pipe 100 extends between the bending assemblies 12, yet is substantially tangential to the outer circumference 30C of both hubs 30. Accordingly prior to insertion of the pipe 100, the roller assemblies 34 where again positioned parallel to each other, but are here facing in opposite directions at complementary clockwise positions: perhaps '4:30' and '10:30' positions. Once again, the shoes 62 engage the pipe between the roller assemblies 34, but at different positions than illustrated in FIGS. 2 and 3. In general, the shoes 62 are place inwardly of (between) the prospective bends. From the starting position indicated in FIG. 7, complementary bends can be created. Creating a 'zigzag' or offset involves simply moving the roller assemblies 34 in opposite directions until they are face fully opposite from each other: in 6 o'clock and 12 o'clock positions. However, it is clear in FIG. 8 that a very different result was desired, in particular, one of the roller assemblies 34 was operated past the 12 o'clock position until it reached the 3 o'clock position—resulting in an unusual shape with perpendicular ends—perhaps useful for 'jogging' a pipe conduit to extend around a vertical column in a building structure. Thus, it is clear that numerous results can be obtained with the pipe bending system, by planning the desired result, positioning the bending assemblies 12 at the desired distance from each other, setting the roller assemblies 34 at initial positions suitable for the bending operation yet parallel to each other to allow the pipe to be inserted therebetween, inserting the pipe 100 and securing the same with the shoe assemblies 60, and then operating each of the bending assemblies 12 to move their respective roller assemblies 34 through the desired range of angular motion to produce the desired bend.

Figure 9:
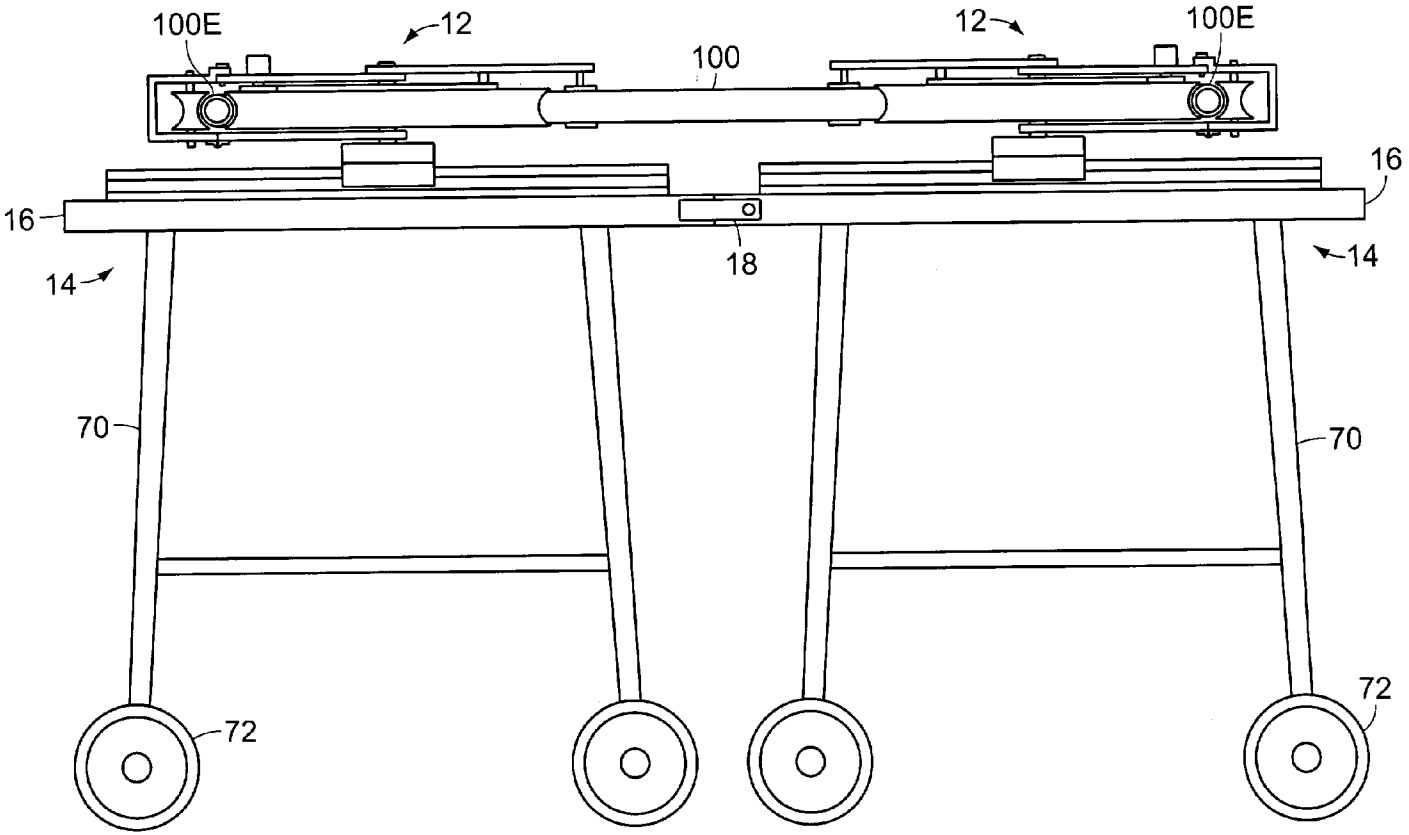
FIG. 9 is a side elevational view of the pipe bending system, in the configuration generally shown by FIG. 3, detailing portions thereof, and showing the preferred portable mounting upon two movable tables.

FIG. 9 illustrates the bending assemblies 12 mounted upon their respective table portions 14. The tabletops 16 are joined together with the tabs 18 as the bending assemblies 12 are in use, bending a pipe 100. The tabletop 16 of each table portion 14 may be supported by a frame 70, and wheels 72 to facilitate portability. In addition, the seperability of the table portions 14 for transport allows the bending system 10 to be brought to job sites which would not allow them to be brought if the table portions 14 were permanently attached.

In conclusion, herein is presented a system for effectively bending pipes in a variety of different ways, according to the intended application. The invention is illustrated by example herein in the foregoing description and in the accompanying drawings. Numerous variations are possible, while adhering to the inventive concept. Such variations are contemplated as being a part of the present invention.

What is claimed is:

1. A pipe bending system, for bending pipes having a pipe outer circumference, comprising:

a pair of bending assemblies, the bending assemblies located at fixable relative positions, each bending assembly having:

a substantially circular central hub having a hub top, a hub outer circumference, and a hub flange at the hub outer circumference, a vertical central shaft is fixed to the hub and is located centrally thereon, the hub further having a fixed gear mounted on the hub top, the fixed gear having fixed gear teeth, a roller assembly, including a roller arm attached at one end to the central shaft for rotatable movement thereon, a roller mounted to the roller arm outwardly of the roller circumference, the roller having a roller flange opposed from the outer circumference for accommodating a pipe between the roller flange and the hub flange, and a motor, mounted on the roller assembly, the motor driving a pinion having pinion teeth in mesh with the gear teeth, for moving the roller assembly angularly around the hub while the roller flange and hub flange remain in contact with a pipe inserted therebetween, for bending the pipe to follow the outer circumference as the roller arm moves angularly around the hub and thereby moves the roller to follow the outer circumference at a fixed radial distance therefrom;

a pair of shoe assemblies, each mountable between the bending assemblies, for engaging the pipe between the bending assemblies and securing the pipe as it is bent; and wherein a pipe is insertable between the roller flange and hub flange of both bending assemblies simultaneously, such that the pipe may be bent is a complex shape by operating both bending assemblies.

2. The pipe bending system as recited in claim 1, further comprising a pair of table portions, each table portion having a tabletop, a pair of sides, and an inner surface, each bending assembly is mounted upon the tabletop of one of the table portions, the inner surfaces of said table portions are selectively fastenable together when bending pipe, and are detachable for transport.

3. The pipe bending system as recited in claim 2, wherein the roller arm further comprises an upper arm extending above the hub, a lower arm extending below the hub, and a bridge vertically attaching the upper and lower arm, the roller attached to the upper and lower arms, the roller rotates upon an axis extending vertically between the upper and lower arms.

4. The pipe bending system as recited in claim 3, wherein the roller arm assembly further has an inner portion and an outer portion, the upper plate having a latch, and the lower plate having a hinge for selectively allowing the lower plate to pivot downward to facilitate the introduction or removal of a pipe between the hub flange and roller flange, and for selectively securing the upper plate while bending is carried out.

5. The pipe bending system as recited in claim 4, further comprising a pair of table portions, which may be selectively mated together, each of the table portions having a tabletop, wherein one of the bending assemblies is mounted upon each tabletop.

6. The pipe bending system as recited in claim 5, wherein each bending assembly has a base, the hub of each bending assembly mounted upon said base, and wherein each bending assembly has a track assembly mounted between the base and tabletop to facilitate adjustment of the distance between bending assemblies.

* * * * *